United States Patent [19]

Sasaki et al.

[11] Patent Number: 4,948,574

[45] Date of Patent: Aug. 14, 1990

[54] METHOD OF MANUFACTURING OF PITCH-BASE CARBON FIBER

[75] Inventors: Hideharu Sasaki, Matsuyama; Toru Sawaki, Iwakuni, both of Japan

[73] Assignee: Teijin Limited, Osaka, Japan

[21] Appl. No.: 351,254

[22] Filed: May 8, 1989

Related U.S. Application Data

[63] Continuation of Ser. No. 88,741, Aug. 24, 1987, abandoned, which is a continuation-in-part of Ser. No. 943,822, Dec. 29, 1986, abandoned, which is a continuation of Ser. No. 751,191, Jul. 2, 1985, abandoned.

[30] Foreign Application Priority Data

Jul. 10, 1984 [JP] Japan ..... 59-141391

[51] Int. Cl.[5] ..... D01F 9/12

[52] U.S. Cl. ..... 423/447.4; 423/447.1; 423/447.2; 423/447.6; 264/29.2

[58] Field of Search ..... 423/447.1, 447.2, 447.4, 423/447.6; 264/29.2

[56] References Cited

U.S. PATENT DOCUMENTS

| | | | |
|---|---|---|---|
| 3,427,120 | 2/1969 | Shindo et al. | 423/447.6 |
| 3,529,934 | 9/1970 | Shindo | 423/447.6 |
| 3,552,922 | 1/1971 | Ishikawa et al. | 423/447.4 |
| 3,746,506 | 7/1973 | Aitken et al. | 423/447.1 |
| 4,112,059 | 9/1978 | DeEduardo et al. | 423/447.6 |
| 4,356,158 | 10/1982 | Ishikawa et al. | 423/447.4 |
| 4,603,041 | 7/1986 | Sweeny | 264/29.2 |
| 4,628,001 | 12/1986 | Sasaki et al. | 423/447.2 |

FOREIGN PATENT DOCUMENTS

| | | | |
|---|---|---|---|
| 2027384 | 12/1970 | Fed. Rep. of Germany | 423/447.1 |
| 2112455 | 10/1971 | Fed. Rep. of Germany | 423/447.1 |
| 2204571 | 5/1974 | France | 423/447.1 |
| 2296032 | 7/1976 | France | 423/447.1 |
| 47-41042 | 12/1972 | Japan | 423/447.4 |
| 59-112028 | 6/1984 | Japan | 264/29.2 |
| 60-155713 | 8/1985 | Japan | 423/447.1 |
| 1538042 | 3/1972 | United Kingdom | 423/447.1 |
| 1308536 | 2/1973 | United Kingdom | 423/447.4 |

*Primary Examiner*—Robert L. Stoll
*Assistant Examiner*—Robert Kunemond
*Attorney, Agent, or Firm*—Kenyon & Kenyon

[57] ABSTRACT

A method of manufacture of pitch-based carbon fiber by infusibilization of pitch fiber followed by carbonization, comprising doping the pitch fiber with at least 0.05 percent by weight of iodine, heating under an oxidizing atmosphere for infusibilization, and then heating under an inert atmosphere for carbonization, whereby it is carbonized or graphitized.

10 Claims, No Drawings

METHOD OF MANUFACTURING OF PITCH-BASE CARBON FIBER

CROSS-REFERENCES TO RELATED APPLICATIONS

This application is a continuation of application Ser. No. 088,841, filed Aug. 24, 1987, now abandoned, is a continuation-in-part of U.S. Pat. Application Ser. No. 943,822 filed on Dec. 29, 1986 now abn. which is in turn a continuation of U.S. Pat. Application Ser. No. 751,191 filed on July 2, 1985, now abandoned.

BACKGROUND OF THE INVENTION (1) Field of the Invention

The present invention relates to a method for manufacturing carbon fiber by infusibilization of pitch fiber followed by carbonization or graphitization.

(2) Description of the Related Art

Carbon fiber was originally manufactured using rayon as the precursor material. Due to their characteristics and economy, however, PAN-type carbon fiber using polyacrylonitrile as the precursor material or pitch-based carbon fiber using petroleum pitch as the precursor material have become dominant.

The technology for manufacturing so-called high-performance pitch-based carbon fiber with a high strength and high Young's modulus using coal or petroleum pitch has been winning wide interest due to its superior economy. For example, the method of manufacturing a high strength, high modulus carbon fiber by infusibilization of pitch fiber obtained by melt spinning mesophase or premesophase pitch in an oxidizing atmosphere followed by carbonization in an inert atmosphere is known (Japanese Unexamined Patent Publication (Kokai) No. 49-19127, Japanese Unexamined Patent Publication (Kokai) No. 51-11983, and Japanese Unexamined Patent Publication (Kokai) No. 59-53717).

The method for manufacturing pitch-based carbon fiber generally comprises a process for the preparation of the pitch, a process for the melt spinning of the pitch, a process for infusibilization, where the spun pitch fiber is heated for a long period in an oxidizing atmosphere (for example, heated at 250° C. to 500° C. for approximately 1 to 2 hours) for infusibilization, and a carbonization process, where the infusibilized fiber is further heated at a high temperature for carbonization or graphitization for the formation of carbon fiber.

Of these, the infusibilization process is an extremely important process in the sense of governing the productivity and fiber physical properties in the industrial manufacture of pitch-based carbon fiber. In particular, the reduction of the infusibilization time is important for the improvement of the productivity of carbon fiber. For this reason, the temperature, rate of temperature rise, atmosphere gas, and the like of the infusibilization are being studied. Further studies are also being conducted on various infusibilization accelerators.

For example, Japanese Unexamined Patent Publication (Kokai) No. 49-75828 corresponding to DE 2,350,769, Japanese Unexamined Patent Publication (Kokai) No. 51-75126 corresponding to GB 1,454,629, Japanese Unexamined Patent Publication (Kokai) No. 59-1723, etc. propose methods for the treatment of pitch fiber under an oxidizing gas atmosphere containing a halogen, particularly chlorine. However, these methods suffer from the problems of insufficient reduction of the infusibilization time, insufficient strength of the obtained fiber, etc. Further, when using chlorine, the chlorine is used in a state mixed with the oxidizing gas and at a high temperature, so there are problems in the work environment and corrosion of facilities, making such use unpreferable. Further, Japanese Unexamined Patent Publication (Kokai) No. 51-88729 corresponding to GB 1,538,042 proposes a method for steeping the pitch fiber in an aqueous solution of chlorine and then heat treating it in an oxidizing atmosphere. This method, however, suffers from the same problems as mentioned above.

In addition, proposals have been made for the use of metal salts, ammonium salts, inorganic acids, nitrides, and the like as accelerators for infusibilization. From the viewpoint of the effects of acceleration of infusibilization and the physical properties of the carbon fiber after carbonization, however, no satisfactory one has yet been found.

The present inventors and other previously made studies on the treatment temperature, rate of temperature rise, and the like in the infusibilization process, and as a result, selected a specific range of these conditions, proposing a method where the time required for infusibilization could be reduced to less than 30 minutes (Japanese Patent Application No. 59-9455). A further reduction of the time of the infusibilization process, however, is desired.

SUMMARY OF THE INVENTION

The primary object of the present invention is to provide a method for significantly reducing the time required for infusibilization in the manufacture of pitch-based carbon fiber, which has been a major problem in productivity, and to improve the physical properties of the carbon fiber after carbonization.

The above-mentioned object is achieved, according to the present invention, in the infusibilization of pitch fiber followed by carbonization for the manufacture of carbon fiber, by doping the pitch fiber with at least 0.05 percent by weight of iodine, heating under an oxidizing atmosphere for infusibilization, then heating under an inert atmosphere, whereby it is carbonized or graphitized.

DESCRIPTION OF THE PREFERRED EMBODIMENTS

The pitch fiber used in the method of the present invention is fiber which is melt spun form coal or petroleum pitch. In the present invention, the infusibilization time can be reduced irregardless of the composition of the pitch, but for the manufacture of high-performance carbon fiber, it is preferable to use pitch fiber obtained by melt spinning pitch formed by heat treatment of coal and/or petroleum pitch, containing an optically anisotropic component and having quinoline insoluble matter of 1 to 60 percent by weight.

When the quinoline insoluble matter of the pitch is less than 1 percent by weight, the melting point of the pitch fiber becomes low, a long time is required for the infusibilization, and the physical properties of the carbon fiber obtained also tend to be lower. On the other hand, when the quinoline insoluble matter is greater than 60 percent by weight, the spinability of the pitch becomes poor and a satisfactory pitch fiber is difficult to obtain. Further, the physical properties of the carbon fiber obtained therefrom also become poorer.

The pitch fiber in question can be manufactured by the methods described in Japanese Unexamined Patent Publication (Kokai) No. 51-119835, Japanese Examined Patent Publication (Kokoku) No. 54-160427, Japanese Unexamined Patent Publication (Kokai) No. 58-18421, etc., but the pitch fiber described in Japanese Unexamined Patent Publication (Kokai) No. 59-36726 is particularly preferable since carbon fiber with superior physical properties can be obtained.

It is preferable, from the viewpoint of the shorter time required for the infusibilization, that the pitch fiber used in the method of the present invention has a high melting point, as the starting temperature of the infusibilization can be increased as high as the melting point. In this sense, said pitch fiber is preferably one with a melting point measured by DSC of 250° C. or more. Fiber with a melting point less than 250° C. is not preferable in that the starting temperature of the infusibilization must be set low and a longer time is required for the infusibilization.

The filament diameter (diameter of a single fiber) of the pitch fiber affects the infusibilization time and the physical properties of the carbon fiber. Specifically, the smaller the filament diameter, the more the time for the infusibilization can be reduced and, further, the greater the strength of the resulting carbon fiber after carbonization. Therefore, in the method of the present invention, fiber with a filament diameter of 15 microns or less, in particular 1 to 10 microns, is preferably used as pitch fiber.

In the method of the present invention, before heating the pitch fiber under an oxidizing atmosphere for the infusibilization, as mentioned above, the pitch fiber is doped with at least 0.05 percent by weight of iodine. The "doping" referred to here means having the iodine absorbed, steeped into, or attached to the inside and/or surface of the fiber. The iodine may or may not react with the pitch including the fiber.

The amount of doping of the iodine should be adjusted to at least 0.05 percent by weight based on the weight of the pitch fiber. In particular, 0.1 to 3 percent by weight is preferable, but about 5 percent by weight may be suitable. With an amount of doping of iodine of less than 0.05 percent by weight, almost no effect on the reduction of the infusibilization time is observed and, further, fusion occurs when attempting to perform the infusibilization in a short time. The doping may be performed by any method, but for industrial purposes, the method of placing the pitch fiber into gasified iodine for absorption of iodine in the fiber, the method of dissolving the iodine in a solvent inactive with respect to pitch (for example, fatty alcohols, etc.), coating the pitch fiber with or immersing it in said solvent, then removing the solvent, etc. may be used.

In the method of the present invention, the pitch fiber doped with iodine in this way is used for the infusibilization. If the following specific heating conditions are adopted for the infusibilization, however, the effects of the iodine doping may be further promoted and the time required for the infusibilization further reduced.

Specifically, in the infusibilization of doped pitch fiber, the infusibilization is begun at a temperature of 25 to 100 degrees centigrade lower than the melting point of the pitch fiber before doping, the temperature is raised continuously or in stages at a rate of temperature rise of 5 to 100 degrees centigrade per minute (preferably from 10 to 50 degrees centigrade per minute) from the start of infusibilization to heat until 300° C., and, above 300° C., the temperature is raised continuously or in stages at a rate of temperature rise both above the rate of temperature rise employed up until then and in the range of 10 to 500 degrees centigrade per minute (preferably from 20 to 400 degrees centigrade per minute) to heat until 300° C. to 500° C.

These heating conditions, when drawing the temperature pattern with the atmospheric heating (set) temperature on the ordinate and the infusibilization time on the abscissa, lie within the range of slope of 5 degrees centigrade per minute or more and 100 degrees centigrade per minute or less from the start of the infusibilization to 300° C. and lie within the range of a slope of 10 degrees centigrade per minute or more and 500 degrees centigrade per minute or less in the region above 300° C. Throughout the regions, the slope is constant or sharper to the high temperature side.

In the infusibilization, the heating temperature may be raised continuously or may be raised in stages. In the latter case, the rage of temperature rise having a slope of the line connecting the turns on the left of the temperature pattern exhibiting the step pattern is used. In this case, the time in which a constant temperature is held should be made as short as possible, with a constant temperature holding time of within 3 minutes being preferable.

Further, the final temperature of the infusibilization is preferably 300° C. to 500° C. If the heating is performed so that the final temperature falls within this range, there is the advantage that the strength of the infusibilized fiber can be increased.

The oxidizing atmosphere in which the infusibilization is performed is most economically air, which is also preferable in the sense of easy handling but an atmosphere adjusted in oxygen concentration is also possible in accordance with need. In the latter case, it is appropriate to increase the oxygen concentration in the lower temperature region and to reduce the oxygen concentration in the high temperature region. Further, NO, $SO_2$, and other active gases may also be mixed with the air. A gas mixture of iodine and air may also be employed.

On the other hand, it is also possible to perform the latter stage of the infusibilization in a substantially inert atmosphere. In this case, the atmosphere used is nitrogen, argon, helium, etc., but the atmosphere may contain a small amount of oxygen (for example, 10 percent or less).

In either case, the pitch fiber doped with iodine is infusibilized extremely quickly, so more sever conditions than the heating conditions in conventional infusibilization, i.e., a high rate of temperature rise, may be employed and said maximum temperature reached within 10 minutes from the start of infusibilization (in almost all cases, within a few minutes).

In the above-mentioned infusibilization process, the pitch fiber is usually treated in a multifilament yarn state where a plurality of filaments are bound together, however, it is preferable that the filaments comprising the said yarn be treated in a state where they are not in mutual contact. If the filaments come into contact with each other during the infusibilization, fusion tends to occur more easily the greater the rate of temperature rise, which can lead to surface defects in the fiber. Therefore, when performing the method of the present invention, it is preferable that the fiber as just spun be doped with iodine and then be infusibilized in a still unbound state or else be doped, then a surface of the fiber be coated uniformly with a fusion preventing agent and then subjected to infusibilization. Some appropriate fusion preventing agents are inorganic fine powders, preferably having an average particle size of not more than 1 μm, of silicon dioxide, aluminum oxide, titanium oxide, boron carbide, and the like. The application of the fusion preventing agent may be carried out before or after the doping with iodine.

In the present invention, the above-mentioned inorganic fine powders may be used singly or in the form of a mixture of two or more of them.

As means for attaching the fine powder to the precursor fiber bundle, there can be adopted (i) a method in which the fine powder is directly sprayed onto the fiber bundle by using a gas as a dispersion medium, (ii) a method in which a dispersion bath is prepared in advance by dispersing the fine powder in a liquid dispersion medium such as water and the fiber bundle is immersed in a dispersion bath and then dried, and (iii) a method in which the fine powder is dispersed in a liquid dispersion medium such as water and the dispersion is coated on the fiber bundle by a roller or the like, or the dispersion is applied to the fiber bundle by spraying.

Since pitch fibers are used as the precursor fibers in the present invention and since the strength of the pitch fibers is very low, method (i) is preferred. If methods (ii) and (iii) are adopted, it is necessary to prevent reduction of the separability at the drying step by using a surface active agent or the like. When the inorganic fine powder is directly sprayed onto the fiber bundle by using a gas as the dispersion medium, as in method (i), to ensure that the fine powder is uniformly attached to the fiber bundle, it is preferred that spraying be effected between the spinning and winding operations at melt-spinning process of pitch fibers.

The amount of the inorganic fine powder stuck to the precursor fibers is preferably 0.05 to 5%, especially 0.1 to 3%, by weight based on the weight of the fibers. If the amount attached of the inorganic powder is too small, the effects of the present invention are insufficient, and if the amount of the inorganic powder is too large, it is feared that various problems will arise during the infusibilization and carbonization treatments and during the post treatments. Accordingly, in either case, good results cannot be obtained.

Such a treatment of the pitch fiber with inorganic fine powders is described in detail in U.S. Pat. No. 4,840,762.

Such infusibilized fiber is then heated to a temperature of over 1000° C. in an inert atmosphere for carbonization. This carbonization may be performed using conventional, known conditions, but for industrial purposes it is appropriate that the temperature be gradually raised for heating to a temperature of 1000° C. or more in nitrogen, argon, helium, or other inert gas (in this case, existence of oxygen not allowed) and thus carbonization or graphitization of the infusibilized fiber be effected.

Further, in this invention, it is preferable that the pitch to be melt spun be prepared and the resulting pitch be spun according to the procedures as mentioned in U.S. Pat. No. 4,628,001. By such a measure, there can be obtained high-strength, high modulus, pitch-based carbon fiber having a unique leafy lamella arrangement in the fiber cross-sectional area and having a high tensile strength.

As explained above, according to the method of the present invention, in the manufacture of the pitch-based carbon fiber, the time required for the infusibilization, which is conventionally one hour or more, may be reduced to approximately 10 minutes or less. Further the carbon fiber after the carbonization has excellent physical properties.

Further, according to the method of the present invention, if the heating conditions of the infusibilization are appropriately selected, the strength of the carbon fiber after carbonization can be considerably improved.

Therefore, according to the method of the present invention, it is possible to manufacture pitch-based carbon fiber of a high performance extremely efficiently and the obtained carbon fiber can be used for a wide range of applications, such as reinforcement for rubber, synthetic resin, metals, etc.

METHODS FOR MEASURING PARAMETERS

The methods for measuring the parameters indicating the characteristics of the pitch and fibers in the present invention will now be described.

(a) Melting Point of Pitch to Be Spun (mp)

By using a melting point measuring apparatus Model DSC-ID supplied by Perkin-Elmer Co., 10 mg of a finely divided pitch having a size smaller than 100 mesh is charged into an aluminum cell having an inner diameter of 5 mm and the measurement is effected in a nitrogen atmosphere while elevating the temperature to about 400° C. at a temperature-elevating rate of 10° C./min, and the temperature of the endothermic peak indicating the melting point in the DSC chart is designated as the melting point of the pitch to be spun. This point is the temperature at which the pitch begins to transform from a solid to a liquid.

(b) Optical Anisotropy of Pitch to Be Spun

Five reflection type polarized microscope photographs are optionally selected, and with respect to each photograph, the area ratio (%) of the anisotropic region is determined by using an image analysis treatment apparatus, and the optically anisotropic phase content (or optical anisotropy) is expressed by the mean value of the obtained values.

(c) Physical Properties of Carbon Fibers

The fiber diameter (single fiber diameter), tensile strength, elongation, and modulus are determined according to the methods specified in JIS R-7601, "Test Methods for Carbon Fibers".

The diameter of fibers having a circular section is measured by a laser device, and with respect to fibers having a non-circular section, an average value of sectional areas of $n = 15$ is calculated from a scanning type electron microscope photograph. In the examples given hereinafter, the diameter of a circle having a corresponding sectional area is expressed as the fiber diameter.

(d) Iodine Doping Amount

The iodine ($I_2$) doping amount is determined from the difference in the weight percentage of iodine contained in the medium for iodine doping before and after the iodine doping treatment.

Below, a more detailed explanation will be made of the present invention using non-limitative examples and comparative examples.

EXAMPLES 1 to 5

Using coal tar pitch as precursor material, pitch for spinning use fluid at room temperature, having an optically anisotropic composition, and with quinoline insoluble matter (QI) of 37.5 percent by weight and melting point (mp) of 280° C. was prepared by the method described in Japanese Unexamined Patent Publication (Kokai) No. 58-18421. The said spinning use pitch was loaded into a quantitative feeder equipped with a heater, melted to a bubbling state, then supplied through a separately provided heating zone to a spinneret for melt spinning. The discharge of the feed was 0.051 ml/min/hole, the heating zone temperature 370° C., the length/diameter of the spinneret (L/D) 0.72/0.18, and the spinneret temperature 340° C.

The yarnlike pitch bundle discharged from the fine holes of the spinneret was taken up at a speed of 800 m/min to obtain a pitch fiber with a filament diameter of approximately 9 microns. The pitch fiber was steeped in a methanol solution of iodine for various amounts of iodine doping. It was then coated with 0.7% by weight based on the weight of the pitch fiber of fine silicon oxide powder having an average particle size of 0.007 μm as a fusion preventing agent, then heated in air under conditions of 250° C. ×2 minutes 300° C. ×2 minutes →350° C. ×2 minutes for infusibilization.

Next, the infusibilized fiber obtained in this way was raised in temperature in a nitrogen atmosphere at a rate of temperature rise of 500 degrees centigrade per minute to 1500° C. and held there for 5 minutes for carbonization and the formation of carbon fiber. The $I_2$ doping amounts and physical properties of the carbon fibers obtained are shown in Table 1.

TABLE 1

| No. | $I_2$ doping amount (wt. %) | Carbon fiber Strength (kg/mm$^2$) | Carbon fiber Elongation at break (%) | Notes |
|---|---|---|---|---|
| Example 1 | 0.2 | 282 | 1.7 | No fusion, little variation in physical properties |
| Example 2 | 0.4 | 267 | 1.6 | No fusion, little variation in physical properties |
| Example 3 | 0.8 | 266 | 1.6 | No fusion, little variation in physical properties |
| Example 4 | 1.2 | 275 | 1.7 | No fusion, little variation in physical properties |
| Example 5 | 2.0 | 284 | 1.7 | No fusion, little variation in physical properties |

EXAMPLE 6

The fraction soluble in tetrahydrofuran and insoluble in toluene was taken out from petroleum pitch (Ashland 240) and heat treated in nitrogen at 440° C. at ordinary pressure for 10 minutes, whereby a spinning use pitch with a melting point (mp) of 272° C. and quinoline insoluble matter (QI) of 35 percent was obtained.

This pitch was treated in the same way as that of Example 1, i.e., melt spun with a heat zone temperature of 360° C. and a spinneret temperature of 345° C., to obtain pitch fiber with a diameter of approximately 9 microns. The said pitch fiber was steeped in a methanol solution of iodine, dried, then doped (adhered) with 1 percent iodine. The fiber was coated with fine silicon oxide powder having an average particle size of 0.007 μm as a fusion preventing agent, then heated in air under conditions of 250° C. ×2 minutes →300° C. ×2 minutes →350° C. ×2 minutes for infusibilization. The obtained infusibilized fiber was free from fusion between filaments and supple. The infusibilized fiber was then raised in temperature in a nitrogen atmosphere at a rate of temperature rise of 500 degrees centigrade per minute to 1500° C. and held there for 5 minutes for carbonization, whereby carbon fiber with a strength of 259 kg/mm$^2$ and an elongation at break of 1.7 percent was obtained.

COMPARATIVE EXAMPLES 1 TO 2

(1) The pitch fiber obtained by Example 1 was treated in the same way as in Example 1, except with no doping of iodine, for infusibilization and carbonization. The fiber fused in the infusibilization stage and the physical properties of the carbon fiber after carbonization varied widely. The physical properties of the fiber are shown in the column of Comparative Example 1 in Table 2.

(2) The pitch fiber obtained by Example 1, without doping of iodine, was coated with fine silica powder as a fusion preventing agent, then raised in temperature in air from 200° C. to 300° C. at a rate of temperature rise of 2 degrees centigrade per minute and held at 300° C. for 30 minutes for the infusibilization. The obtained infusibilized fiber was carbonized in the same way as in Example 1 at 1500° C. The $I_2$ doping amounts and physical properties of the obtained carbon fiber are shown in the column of Comparative Example 2 in Table 2. In this case, the time required for the infusibilization was 80 minutes.

TABLE 2

| No. | $I_2$ doping amount (wt %) | Caron Fiber Strength (kg/mm$^2$) | Caron Fiber Elongation at break (%) | Notes |
|---|---|---|---|---|
| Comp. Ex. 1 | — | 145 | 0.9 | Large fusion and variation in physical properties |
| Comp. Ex. 2 | — | 261 | 1.6 | Infusibilization time of 80 min. |

COMPARATIVE EXAMPLE 3

The pitch fiber obtained in Example 6 was subjected to infusibilization treatment under the same conditions as Example 6 except with no iodine adhered thereto. The fiber conspicuously contracted and fused. Fur this reason, while the fiber was carbonized under the same conditions as in Example 6, it did not remain in the fiber state and measurement of the physical properties was impossible.

EXAMPLE 7

The fraction insoluble in toluene at room temperature was taken from coal tar pitch available on the market (melting point (mp) of 90° C., Q1 of 9.5%) by solvent separation. Eight hundred grams of this pitch and 2000 g of tetrahydroquinoline were loaded into a 5 liter autoclave and held at 450° C. for 30 minutes in nitrogen under an automatically raised pressure with agitation, then cooled and taken out. A pressurize filter was used to filter the same at a temperature of 100° C. and the solids removed.

The solvent was removed from the obtained filtrate, which was then subjected to 10 mmHg reduced pressure heat treatment under agitation at 440° C. for 10 minutes.

The obtained pitch was fluid over the whole planes and anisotropic and had quinoline insoluble matter of 23 percent, toluene insoluble matter of 87 percent, a melting point of 285° C., and optical anisotropy of 95 percent. Said spinning use pitch was loaded into a quantitative feeder equipped with a heater, melted to a bubbling state, then supplied through a separately provided heating zone to a spinneret having a width of 60 microns, a length of 540 microns, and land length of 600 microns, by which fiber was taken up at a spinneret temperature of 335° C. and a take up speed of 800 m/min for manufacture of pitch fiber with a circular equivalent diameter of 7.8 microns in elliptical crosssection. The filament had a leafy structure. 10,000 filaments of the pitch fiber were coated with fine silica powder as a fusion preventing agent, then passed through iodine gas for absorption of 0.5 percent by weight of iodine, then infusibilized using an infusibilization furnace. The fiber was passed through a three-stage furnace with temperature settings of 250° C., 300° C., and 350° C. at an equal speed, with the treatment times being changed as shown in Table 3, to obtain infusibilized yarn. This was carbonized in nitrogen at a rate of temperature rise of 500 degrees centigrade per minute to 1300° C. The results obtained are shown in Table 3.

TABLE 3

| Treatment time (min) | Carbon fiber Strength (kg/mm$^2$) | Carbon fiber Elongation at break (%) | Modulus (T/mm$^2$) |
|---|---|---|---|
| 3 | 495 | 2.43 | 20.7 |
| 4 | 442 | 2.13 | 20.8 |
| 6 | 434 | 2.44 | 18.0 |
| 8 | 381 | 2.35 | 16.4 |
| 18 | 375 | 1.97 | 19.7 |
| 28 | 352 | 1.99 | 17.7 |

EXAMPLE 8

10,000 filaments of pitch fiber obtained in the same way as in Example 7 were coated with fine silicon oxide powder, then the fiber bundle adhered with 0.5 percent of iodine, passed through drying air at 250° C. for the first zone and 300° C. for the second zone, then passed through nitrogen with an oxygen concentration of 1 percent or less at 400° C. for the third zone. The total treatment time was 3 minutes. The result was carbonized in nitrogen at a rate of temperature rise of 800° C. per minute until 1300° C. The obtained fiber had a filament diameter of 7.7 microns, a strength of 480 kg/mm$^2$, an elongation at break of 2.13 percent, and a modulus of 22.5 T/mm$^2$ as physical properties.

EXAMPLE 9

10,000 filaments of pitch fiber obtained in the same way as in Example 7 were separated, then coated with 0.8 percent of iodine and passed through an infusibilization furnace set to 250° C., 300° C., and 330° C. in 4 minutes. They were then heated at a rate of temperature rise of 600° C. per minute and carbonized at 1300° C. The physical properties obtained were a filament diameter of 8.0 microns, a strength of 453 kg/mm$^2$, and elongation at break of 1.99 percent, and a modulus of 22.8 T/mm$^2$.

EXAMPLE 10

The procedure as in Example 1 was repeated, except that the pitch fiber was placed in an iodine gas atmosphere instead of being steeped in the methanol solution of iodine, and the heating in air was carried out by raising the temperature from room temperature to 300° C. at a rate of 100° C./min. and maintaining at 300° C. for 2 minutes.

The $I_2$ doping amount and physical properties of the obtained carbon fiber were as follows.

| $I_2$ doping amount (wt %) | Carbon fiber Strength (kg/mm$^2$) | Carbon fiber Elongation at break (%) | Notes |
|---|---|---|---|
| 5.0 | 294 | 1.8 | No fusion |

We claim:

1. A method of manufacture of pitch-based carbon fiber by infusibilization of pitch fiber followed by carbonization, comprising doping the pitch fiber with at least 0.5 percent by weight of iodine, whereby the doping is effected by placing the pitch fiber into gaseous iodine, heating under an oxidizing atmosphere for infusibilization, whereby the fiber is infusibilized in about 10 minutes or less, and then heating under an inert atmosphere for carbonization, whereby it is carbonized or graphitized.

2. A method according to claim 1, wherein the pitch fiber has a melting point of 250° C. or more.

3. A method according to claim 1, wherein the pitch fiber has a diameter of 15 microns or less.

4. A method according to claim 1, wherein the pitch fiber is doped by being treated with an iodine solution.

5. A method according to claim 1, wherein the pitch fiber is doped in a gaseous atmosphere containing iodine.

6. A method according to claim 1, wherein the pitch fiber to be infusibilized is attached with a fine powder of at least one member selected from oxides and carbides of silicon, aluminum, titanium, and boron.

7. A method according to claim 6, wherein the fine powder is a fine powder of silicon oxide, aluminum oxide, titanium oxide, titanium carbide, or boron carbide.

8. A method according to claim 1, wherein the heating for infusibilization is carried out in air.

9. A method of infusibilizing pitch fiber for carbonization, comprising doping the pitch fiber with at least 0.05 percent by weight of iodine, whereby the doping is effected by placing the pitch fiber into gaseous iodine, and heating under an oxidizing atmosphere for infusibilization, whereby the fiber is infusibilized in about 10 minutes of less.

10. A method according to claim 9, wherein the heating for infusibilization is carried out in air.

* * * * *

UNITED STATES PATENT AND TRADEMARK OFFICE

CERTIFICATE OF CORRECTION

PATENT NO. : 4,948,574

DATED : August 14, 1990

INVENTOR(S) : H. Sasaki, et al.

It is certified that error appears in the above-identified patent and that said Letters Patent is hereby corrected as shown below:

Column 2, line 18, change "other" to --others--.

Column 4, line 48, change "sever" to --severe--.

Column 5, line 32, between "at" and "melt-spinning" insert --a--.

Column 8, line 52, change "Fur" to --For--.

Column 10, line 60, change "of" to --or--.

Signed and Sealed this

Fourteenth Day of January, 1992

*Attest:*

HARRY F. MANBECK, JR.

*Attesting Officer*

*Commissioner of Patents and Trademarks*